US005411144A

United States Patent [19]

Deupree

[11] Patent Number: 5,411,144

[45] Date of Patent: May 2, 1995

[54] HAT RACK

[76] Inventor: David W. Deupree, 18601 Salisbury Rd., Independence, Mo. 64056

[21] Appl. No.: 832,746

[22] Filed: Feb. 7, 1992

[51] Int. Cl.[6] ..... A47F 7/00

[52] U.S. Cl. ..... 211/30; 211/32; 211/87

[58] Field of Search ..... 211/30, 32, 33, 87, 211/89, 70.1, 72, 73, 41, 45; 40/124, 124.4

[56] References Cited

U.S. PATENT DOCUMENTS

| | | | |
|---|---|---|---|
| 1,334,545 | 3/1920 | Londelius | 211/70.1 X |
| 1,449,698 | 3/1923 | Roragen et al. | 211/32 X |
| 1,608,758 | 11/1926 | Alexander . | |
| 1,652,114 | 12/1927 | Gestrine | 211/41 X |
| 1,986,486 | 1/1935 | Swanson . | |
| 2,185,086 | 12/1939 | Janke | 40/124 |
| 2,313,620 | 3/1943 | Brunner | 211/70.1 |
| 2,535,136 | 12/1950 | Jacobson . | |
| 2,612,274 | 9/1952 | Earll | 211/89 |
| 2,639,081 | 5/1953 | Metzger | 211/70.1 X |
| 2,994,437 | 8/1961 | Nyitrai . | |
| 4,673,153 | 6/1987 | Hilty et al. | 211/30 X |
| 5,002,190 | 3/1991 | Moreland . | |
| 5,038,941 | 8/1991 | Bastiaansen . | |
| 5,137,157 | 8/1992 | Lawson | 211/32 |

*Primary Examiner*—Robert W. Gibson, Jr.
*Attorney, Agent, or Firm*—Kokjer, Kircher, Bowman & Johnson

[57] ABSTRACT

A cap rack in the form of an elongated bar. The elongated bar is placed in a substantially vertical orientation and includes a laterally central portion which extends forward with respect to the lateral side edges. A laterally extending slot extends through the rack for each cap to be retained therein, with each of the slots including an enlarged portion at one end thereof. When the body of the baseball type cap is folded such that the rear portion is reversed and retained within the front portion, a substantially planar fold line is formed. This fold line is received within the slot in the rack. Where the cap is of the type having a central upper button or peen, this peen may be inserted through the enlarged portion in the slot. As such, the peen will be retained behind the laterally central portion of the rack to maintain the cap in place. Two or more of these racks may be connected together at their longitudinal and/or lateral edges to form display racks which may be hung from the ceiling of a store or be placed upon a rod for rotation thereabout.

11 Claims, 2 Drawing Sheets

HAT RACK

BACKGROUND OF THE INVENTION

1. Field of the Invention

The present invention relates in general to racks for hats. In particular, the present invention relates to an improved rack for the storage and display of baseball type caps.

2. Description of the Related Art

The popularity of baseball style caps, having a roughly half spherical body which rests upon the user's head and a forward facing visor extending from the periphery thereof, have increased steadily throughout the years. Such caps typically include indicia related to a sports team, product, company or other expression which will increase the value or desirability of the particular cap in the eyes of the user.

With the proliferation of such indica bearing caps, the problems associated with display of these caps, both for retail sales and by collectors, have increased. In particular, the most logical and stable method for storing the caps is to stack them one upon the other with the body of each cap received within the body of the cap immediately above. While this arrangement is stable, it serves to hide the indicia upon the cap, which may be its most valuable aspect.

Alternatively, the caps may be mounted upon typical hat racks, consisting of numerous cantilevered posts having an upward tilt, such that the free end of the post is received within the body of the cap. However, with this arrangement the indica upon the caps is tilted downward, reducing its visibility. Additionally, the caps are not stable upon these posts and are difficult to be maintained in alignment for an aesthetically pleasing display.

SUMMARY OF THE INVENTION

An object of the present invention is to provide a rack for the display of baseball type caps.

Another object of the present invention is to provide such a rack which will securely retain the cap in a stable position.

Yet another object of the present invention is to provide such a rack which will maintain the caps in a substantially horizontal position with the front indicia clearly visible.

A further object of the present invention is to provide one or more of such racks in a form specifically suited for retail sales displays.

These and other objects are achieved by a cap rack in the form of an elongated bar. The elongated bar is placed in a substantially vertical orientation and includes a laterally central portion which extends forward with respect to the lateral side edges. A laterally extending slot extends through the rack for each cap to be retained therein, with each of the slots including an enlarged portion at one end thereof. When the body of the baseball type cap is folded such that the rear portion is reversed and retained within the front portion, a substantially planar fold line is formed. This fold line is received within the slot in the rack. Where the cap is of the type having a central upper button or peen, this peen may be inserted through the enlarged portion in the slot. As such, the peen will be retained behind the laterally central portion of the rack to maintain the cap in place. Two or more of these racks may be connected together at their longitudinal and/or lateral edges to form display racks which may be hung from the ceiling of a store or be placed upon a rod for rotation thereabout.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
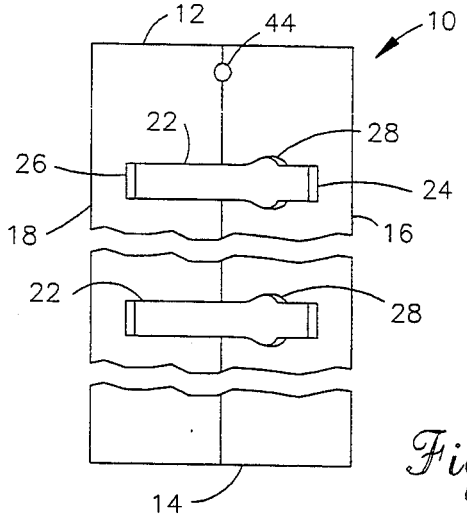
FIG. 1 is a front view according to a first embodiment of the present invention.

With reference to FIG. 1, the device or rack according to the present invention is generally designated by reference numeral 10. The rack 10 is a generally elongated member having longitudinal top and bottom ends 12 and 14 and lateral first and second side edges 16 and 18.

Figure 3:
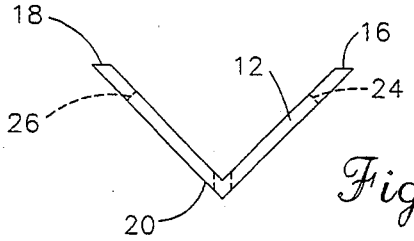
FIG. 3 is a top view of the device of FIG. 1.

As is best shown in FIG. 3, the rack 10 includes a laterally central portion 20 which extends forward with respect to the lateral edges 16 and 18, such that the device has a generally concave configuration in cross section. This concave configuration is an important aspect of the present invention, as will become apparent from the discussion below.

At longitudinally spaced locations along the length of the rack 10 there are formed mounting slots 22. Each of these slots extends through the rack 10 and may be substantially centered laterally of the rack for aesthetic reasons. While the slots 22 need not be perfectly centered, it is important that the slot pass through the laterally central portion 20 such that each of the slots 22 has a concave configuration similar to that of rack 10. Each of the slots 22 includes first and second ends 24 and 26 spaced inwardly from the associated first and second edges 16 and 18.

Figure 2:
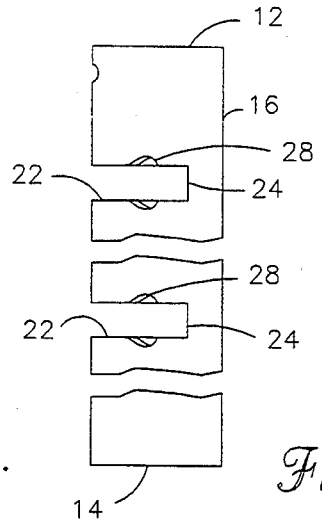
FIG. 2 is a right side view of the device of FIG. 1.

Spaced inwardly from the first end 24, each of the slots 22 includes a longitudinally widened portion 28. As is best shown in FIG. 2, the widened portion 28 preferably takes a roughly elliptical form, although other configurations may be employed. For example, only a single edge of the slot 22 may include a widened portion 28, such that the slot 22 is asymmetrical about a lateral axis. Alternatively, the widened portion may take a circular or rectangular form. The widened portion need not be on the same end for each slot, but may be at alternating ends of the slots on a particular rack. It is also possible to eliminate the widened portion 28 entirely, as will be apparent from the discussion of its function below.

The rack 10 including the slots 22 is preferably formed as a monolithic unit. The rack may be formed of sheet metal, plastics, ceramics, or other materials, although it is well suited to injection molding or extrusion and die cutting.

Figure 5:
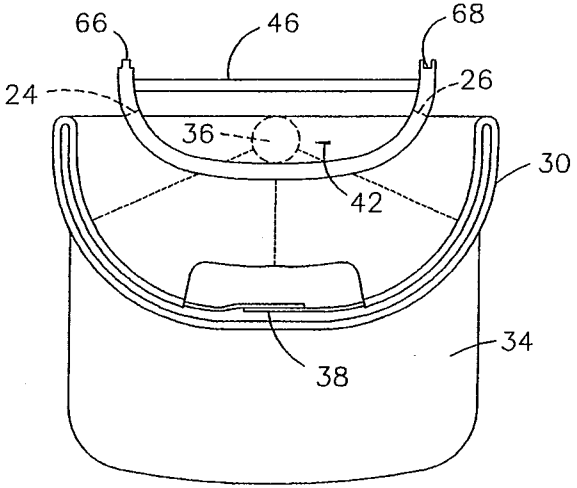
FIG. 5 is a cross-sectional view along line 5—5 of FIG. 4.
Figure 6:
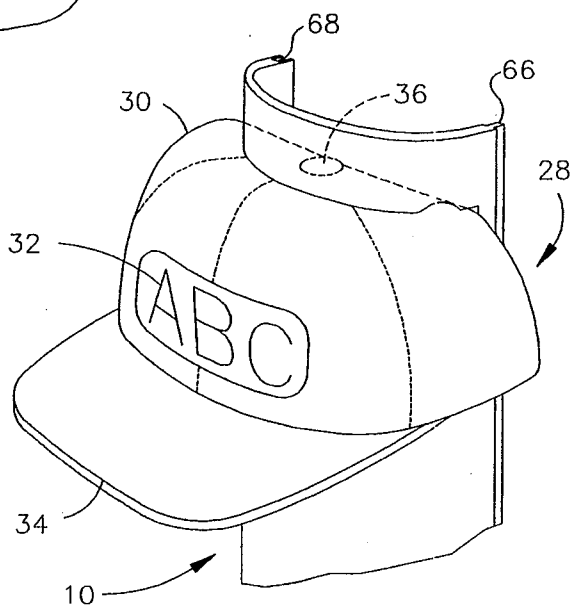
FIG. 6 is a prospective view of the device of FIG. 4.
Figure 4:
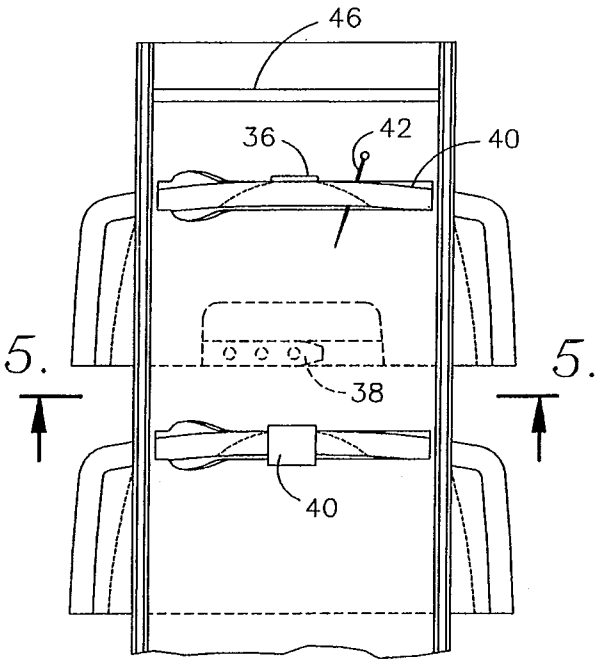
FIG. 4 is a rear view of a second embodiment according to the present invention, showing the mounting of the caps.

The use of the device 10 is illustrated in FIGS. 4–6. Initially, it is noted that the device 10 is to be used with a baseball type cap generally designated by reference numeral 28. The cap 28 includes a semi-flaccid body 30 having a generally semi-spherical configuration. This defines a downwardly opening cavity which receives a portion of the user's head. A forward portion of the body 30 typically includes indicia 32 relating to a sports team, product, company or other expression.

Also at the front, the cap 28 includes a projecting bill 34 connected to the lower periphery of the body and extending outwardly therefrom. The cap 28 may also include a button or peen 36 at a central location at the upper part of the body. Finally, the cap 28 may include a pair of mating adjustment straps 38 at the lower rear periphery of the body 30 such that the periphery of the body may be-adjusted to allow the cap to be fitted to users having different head sizes.

To mount the caps 28 to the rack 10, the caps are first placed in a folded condition best illustrated in FIG. 5. In this position, the rear portion of the body 30 is folded along a substantially horizontal line to be placed in a concave configuration. For reasons which will become clear, where the cap includes a peen 36, this peen is preferably maintained on the upper surface of the body. In other words, the fold line is rearward of the peen 36.

The cap 28 is mounted to the rack 10 by placing the central portion of the fold line of the body, which forms a substantially horizontal ledge 40, within the desired mounting slot 22. To assist in maintaining the cap in position it is preferred that the slot be only slightly greater than the anticipated thickness of this ledge, which essentially corresponds to twice the thickness of the material forming the body 30. In this manner, the portions of the slots adjacent the ends 24 and 26 will maintain the cap in a substantially horizontal orientation, while the forwardly extending central portion 20 serves to maintain the cap level from front to rear of the cap 28. It may thus be seen that this extremely simple structure supports the cap in an manner for proper viewing or display. As shown in FIG. 4, several caps may be mounted in this manner upon a single rack 10, with each of the caps being clearly visible.

Since it is important that the slots 22 have a width which has a fairly close tolerance to the thickness of the folded body, the thickness of the peen may make it very difficult to insert the folded body and the peen 36 through the slot 22. For this reason, the slot 22 is provided with the enlarged portion 28. This portion is of a width which will easily allow the insertion of the folded body and peen.

It is noted, however, that the enlarged portion 28 is laterally offset with respect to the laterally central portion 20. Since the peen, when the cap is mounted on the rack 10, will be in proximity to this portion 20, the relatively reduced width of the slot 22 in this portion will result in the cap 28 being retained on the rack against outward motion. This will serve to securely retain the caps upon the rack should the rack be moved, rotated or tilted.

The widened portion 28 therefore allows mounting and removal of the cap 28. This may be by sliding the cap to a laterally offset position with respect to the rack such that the peen is substantially aligned with the widened portion 28. The cap may then be removed from, or inserted into, the slot 22 by removing, or inserting, the portion of the cap having the peen into the slot.

It is also noted that the preferred location of the widened portion 28 is laterally inward from the first end 24. This will result in a small lateral length of slot 22 having the relative narrow width. While this is not necessary, it does provide additional support for the cap, such that the folded edge of the cap does not tend to bow downwardly within the widened portion, or the cap does not move unduly when the rack is subject to movement.

While it should be readily apparent that the particular dimensions of the slot may vary, operable dimensions are as follows. The width of slot 22 may be approximately 1.6 centimeters ($\frac{5}{8}''$), while the widened portion 28 has a maximum lateral width of approximately 1.9 centimeters ($\frac{3}{4}''$). The slots 22 may have a length of approximately 4.5 centimeters ($2\frac{3}{4}''$) and be spaced from each other in the longitudinal direction of the rack by approximately 9.8 centimeters ($3\frac{7}{8}''$).

As noted above, not all caps include a peen 36. While such caps may be employed with the rack 10, they are not as securely retained upon the rack due to this lack of a peen. In such situations, the caps 28 may be provided with a C-clip 40 of metal, plastic, or other material which engages over the fold line of the body 30 at a substantially central location. The C-clip 40 will have a height approximately equal to the thickness of the folded body and peen, such that the operation of the rack 10 will be substantially similar to a cap having a peen.

In some situations, such as in a private collection of caps 28, it may be desirable to provide additional security against removal of the cap from the rack. To provide such security a hat pin 42 may be inserted through the body 30 at a position behind the rear face of the rack 10. So long as the pin 42 has a length greater than the width of the widened portion 28, removal of the cap 28 will be prevented.

When the desired number of caps 28 have been mounted upon the device 10, this combined arrangement is readily suited for display. For example, the bottom end 14 may be rested upon a surface at a position spaced from a vertically extending wall. The edges 16 and 18 at the top end 12 may then be tilted rearwardly to rest against this vertical wall, displaying the caps 28 upon the rack 10.

Alternatively, the rack 10 may be hung from a vertical wall, either permanently or removably. For example, as shown in FIGS. 1–3, the rack 10 may include one or more mounting holes 44 which may receive a picture hanger or other similar protrusion mounted upon the vertical wall. Alternatively, the device 10 may be provided with a mounting bar 46 as shown in FIGS. 4 and 5. Such a mounting bar may be a portion of the monolithic unit of the rack, or may be a separate pin or rod fixed to the rack.

While individual racks have been described above, it is also possible to arrange a plurality of the racks into a single unit for a more convenient display of a larger quantity of caps. For example, the rack 10 of FIGS. 1–3 or 4–6 could be formed in multi-rack panels with a plurality of the racks arranged in a substantially parallel arrangement with the first and second edges 16 and 18 being located substantially within a common plane. A piece of substantially rigid material would extend between adjacent ones of the racks 10 to provide sufficient lateral spacing, if necessary. For additional strength, such a panel of racks could be formed as a monolithic unit.

Additional multi-rack arrangements also form a part of the present invention. For example, with reference to FIGS. 7 and 8, embodiments of a such arrangements are shown.

Figure 8:
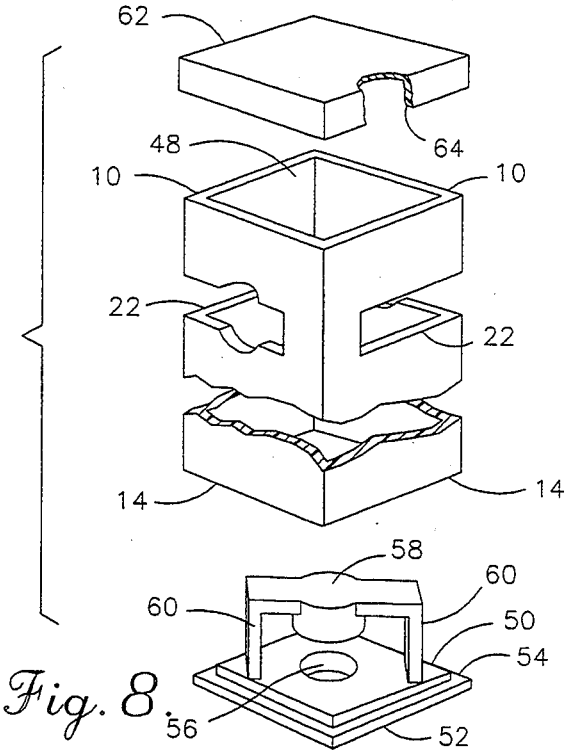
FIG. 8 is an exploded view of a second display arrangement according to the present invention.

As is best shown in FIG. 8, a pair of the racks 10 may be arranged with the edges 16 and 18 in fixed abutting relationship. When employed with the rack embodiment shown in FIGS. 1–3, this will result in a substantially square hollow channel 48. The edges 16 and 18 may be connected by adhesive, thermal bonding or other well known means.

While such a channel could simply be placed upon a flat surface such that the bottom ends of the racks rest thereupon, it is preferred that the channel 48 include means for pivoting such that the caps mounted thereon may be more readily viewed. To this end the channel is provided with a pivot base 50. The pivot base 50 includes a bottom end cap 52 having a peripheral configuration substantially corresponding to that of the channel 48. The upper peripheral edge of the end cap 52 includes a shoulder 54 to improve the mounting of the pivot base to the channel, Specifically, the shoulder 54 will receive the bottom ends 14 of the racks forming the channel 58 such that lateral movement of the end cap with respect to the channel is substantially eliminated.

To allow pivoting, the end cap 52 includes a through hole 56 which will receive a vertically extending pivot rod (not shown) mounted upon a stand(not shown), as is well known in the art. To prevent the channel 48 from tilting with respect to this pivot rod, the pivot base 50 includes a rod cap 58 which includes a downwardly opening cavity adapted to receive the free end of the pivot rod. The rod cap 58 is connected to the end cap 52 by means of stringers 60 which serve to maintain the rod cap in a spaced coaxial configuration with respect to the through hole 56. In use, the pivot rod will extend through the hole 56 with a sliding tolerance and be received, again with a sliding tolerance, within the cavity in the rod cap 58. When the pivot base 50 is connected to the bottom end of the channel 48, this will allow the channel to rotate about an axis substantially coaxial with the longitudinal axis of the pivot rod.

For aesthetic considerations, it may be preferred to additionally include a top cap 62 which mounts upon the top end 12 of the racks 10 forming the channel 48. The top cap 62 may include a downwardly extending rim 64 which extends a short distance over the exterior faces of the racks 10, to maintain the top cap in position. For improved structural integrity, both the pivot base 50 and top cap 62 may be adhesively or thermally secured to the channel 48.

Figure 7:
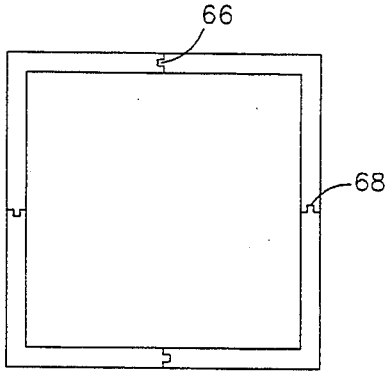
FIG. 7 is a top view of a display arrangement according to the present invention.

An alternative arrangement for channel 48 is shown in FIG. 7. In this figure, the channel 48 is formed of four racks 10, rather than two. Additionally, the edges 16 and 18 of the racks 10 of FIG. 7 may include mating protrusions and grooves to assist in formation of the channel 48. Specifically, each first edge 16 will include a protruding rib 66 which extends along the longitudinal length of the rack 10. Each second edge of each rack 10 will include a mating groove 68, also extending along the longitudinal length of the rack 10. With this arrangement, the ribs 66 of each rack 10 will be received within the grooves 68 of an adjacent rack 10 to aid in maintaining the channel configuration.

While the racks 10 of this embodiment may be secured together by adhesive or thermal welding as in the embodiment of FIG. 8, the rib 66 and groove 68 could be formed such that they produce an interlocking snap fit to maintain the racks in position. The channel arrangement of FIG. 7 could of course be used in a pivotal rack arrangement as in FIG. 8, with the appropriately sized end caps.

Figure 9:
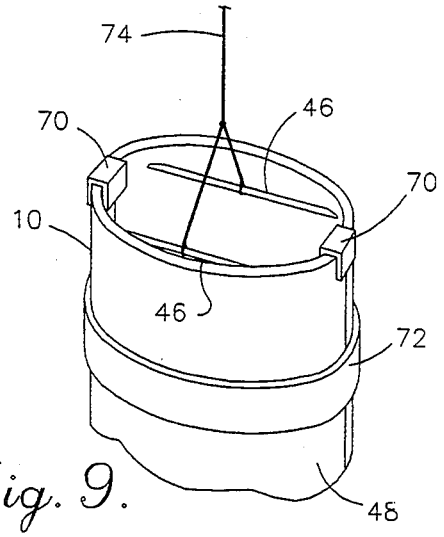
FIG. 9 is a prospective detail view showing a third display arrangement according to the present invention.

A further mounting arrangement is shown in FIG. 9. In this arrangement a pair of racks 10 as shown in FIG. 4–6 are connected together with the first and second edges 16 and 18 in abutting position. This arrangement shows that the racks may be maintained in their relative position by use of exterior mechanical means, such as end clips 70 which have a generally C-shaped cross-section and fictionally engage the racks to maintain the abutting position.

A second mechanical means is also shown as peripheral clip 72. This clip may be formed of a resilient plastic or spring metal which will compress the channel 48 formed by the two racks 10 to maintain them in position. Alternatively, the peripheral clip 72 could be formed of an adhesive tape. In such a situation, the clip 72 need not extend about the entire periphery, but need only pass across the abutting edges 16 and 18.

Also shown in FIG. 9, the mounting bars 46 of the racks forming the channel 48 may be used for attachment of a hanging thread or wire 74. The upper end of this thread 74 may then be mounted upon a ceiling or other structure such that the channel 48 will freely hang and may be rotated by the user to view the caps mounted upon the channel 48.

As is best shown in FIG. 5, the embodiment of FIG. 9 may also include the mating groove and ribs 68 an 66 as in the embodiment of FIG. 7.

As should be apparent from comparison of FIGS. 3 and 5, the cross-sectional configuration of the racks 10 may take many forms. All that is strictly necessary is that the first and second end of the slots 22 are spaced rearwardly with respect to the laterally central portion 20 of each slot. As such, the cross-sectional configuration of the rack may be circular, elliptical as shown in FIG. 5, angular as shown in FIG. 3, or other configurations. For example, the cross-sectional configuration of the rack may take the form of a trapezoid with the shorter parallel side forming the laterally central portion 20. It may also be possible to form the rack as an essentially rectangular configuration, with one of the sides forming the laterally central portion 20.

While the above description of the invention has been made with reference to specific embodiments, it should be apparent to those skilled in the art that various modifications could be made. For example, the mounting holes 44 could be employed with the cross-sectional configuration of the rack shown in FIG. 5. Similarly, the rack of FIG. 3 could include a mounting bar 46 in addition to, or to replace, the mounting hole 44. In a similar manner, the mounting arrangements of FIGS. 8 and 9 may be employed regardless of the cross-sectional configuration of the rack 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations.

This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A rack system for removable storage of baseball-style caps, each of such caps having a generally half-spherical body adapted to receive a portion of the user's head, a visor extending outwardly from a forward portion of the periphery of the body and a button mounted on the body, and the body being capable of being folded about a substantially horizontal line to define a ledge at the fold line with a rear portion of said body being received in opposed relation within a forward portion of the body, such that the button is adjacent the ledge, said rack comprising:

a substantially rigid member having a first portion extending forwardly with respect to laterally adjacent portions; and at least one laterally extending slot extending through said member at a position such that said slot includes said first portion and said laterally adjacent portions, whereby said slot has a generally concave configuration in lateral cross-section and having a width less than the thickness of the ledge and the button combined, said slot being adapted to receive and support the ledge of the cap and including a portion with a relatively widened width adjacent a first lateral end of said slot capable of receiving both the ledge and the button, whereby movement of the cap forward out of said slot is prevented by abutment of the button with said rigid member.

2. A system as in claim 1, wherein said widened portion is spaced from said first lateral end.

3. A system as in claim 2, including a plurality of said slots extending through said member, each of said slots being substantially parallel and spaced from each other.

4. A system as in claim 3, wherein said rigid member is elongated in a longitudinal direction and said slots are substantially aligned, and spaced, in said longitudinal direction.

5. A system as in claim 4, wherein said rigid member has a lateral cross-sectional configuration of a pair of substantially planar elements joined together at an apex, said apex defining said first portion.

6. A rack as in claim 3, further including a plurality of said rigid members, each being substantially identical and having first and second lateral edges and top and bottom ends, said members being arranged with said first and second edges being fixed to said second and first edges, respectively, of at least one adjacent said member, said top and bottom edges of said members being substantially aligned, whereby said plurality of rigid members form a channel having said first portions at spaced positions on the periphery thereof.

7. A system as in claim 6, further including a pivot base connected to said bottom edges of said members.

8. A system as in claim 6, wherein each of said members includes an outwardly extending rib extending along at lest a portion of said first edge, and a groove extending along at least a portion of said second edge, and wherein each of said ribs is engaged in an associated one of said grooves.

9. A system as in claim 4, wherein said member has a lateral cross-sectional configuration substantially corresponding to a half-ellipse, taken along the long axis of such ellipse.

10. A rack as in claim 9, further including a plurality of said rigid members, each being substantially identical and having first and second lateral edges and top and bottom ends, said members being arranged with said first and second edges being fixed to said second and first edges, respectively, of at least one adjacent said member, said top and bottom edges of said members being substantially aligned, whereby said plurality of rigid members form a channel having said first portions at spaced positions on the periphery thereof.

11. A system as in claim 10, wherein each of said members includes an outwardly extending rib extending along at least a portion of said first edge, and a groove extending along at least a portion of said second edge, and wherein each of said ribs is engaged in an associated one of said grooves.

* * * * *